US005376753A

United States Patent [19]

Kosugi et al.

[11] Patent Number: 5,376,753

[45] Date of Patent: Dec. 27, 1994

[54] KEY TOUCH DETECTOR FOR AN ELECTRONIC MUSICAL INSTRUMENT

[75] Inventors: Taichi Kosugi; Yutaka Washiyama, both of Shizuoka, Japan

[73] Assignee: Kabushiki Kaisha Kawai Gakki Seisakusho, Japan

[21] Appl. No.: 44,371

[22] Filed: Apr. 6, 1993

[30] Foreign Application Priority Data

Apr. 20, 1992 [JP] Japan ..... 4-125344

[51] Int. Cl.[5] ..... G10H 1/053; G10H 1/18

[52] U.S. Cl. ..... 84/658; 84/DIG. 7

[58] Field of Search ..... 84/615, 626, 658, 687-690, 84/DIG. 7

[56] References Cited

U.S. PATENT DOCUMENTS 5,229,536 7/1993 Kunimoto ..... 84/658

5,272,274 12/1993 Kimura ..... 84/658

FOREIGN PATENT DOCUMENTS 58-43757 9/1983 Japan .

61-41192 2/1986 Japan .

*Primary Examiner*—Stanley J. Witkowski

*Attorney, Agent, or Firm*—Andrus, Sceales, Starke & Sawall

[57] ABSTRACT

A key touch detector, for an electronic musical instrument, that detects key touch states, comprises: a first switch to be closed at a first key displacement position disposed along the line of travel of a depressed key; a second switch to be closed at a second key displacement position disposed along the line of travel of the depressed key; a key depression detector for detecting the closure of the first switch and the closure of the second switch; a touch data computer for computing touch data for the depressed key during a period that begins following the closure of the first switch and ends with the closure of the second switch; and delay circuitry for deferring initiation of touch data computation by the touch data computer until a predetermined time has elapsed following the closure of the first switch.

9 Claims, 10 Drawing Sheets

KEY TOUCH DETECTOR FOR AN ELECTRONIC MUSICAL INSTRUMENT

BACKGROUND OF THE INVENTION

1. Field of the Invention

The present invention relates to a touch detector that detects key touch states at the keyboard of an electronic musical instrument.

1. Description of the Related Art

Ordinarily, two switches, which are sequentially closed as a key is depressed, are disposed along the line of travel of each key on the keyboard of an electronic musical instrument.

Several well-known conventional methods for employing such switches to determine key depression force, i.e., key depression velocity, that are implemented on electronic musical instruments are:

Method 1. Measurement of the time that elapses between the closing of the first switch and the closing of the second.

Method 2. Compilation of obtained values, as is described in Japanese Examined Publication No. Sho 58-43757, that are calculated, using various performance factors, during the period between the closing of the first switch and the closing of the second.

Method 3. Calculation of exponential function values, as is described in Japanese Unexamined Publication No. Sho 61-41192, during the period between the closing of the first switch and the closing of the second.

To determine key touch states, all of these methods initiate touch detection calculation immediately following the closing of the first switch.

With these conventional methods, however, when the scan cycle time for the first and second switches is shortened, so as to attain an optimum detection accuracy, even when a key is depressed at maximum strength the touch data produced will not reflect a maximum value (or a minimum value, depending on value representations). In other words, the elapsed time between the closure of the first switch and the closure of the second switch will never be "0".

When touch detection calculations to determine key touch states are initiated immediately following the closure of the first switch, however, because key mechanical characteristics delay the closure of the second switch a predetermined time, the calculations performed before the second switch is closed are useless for obtaining touch data.

This adversely affects the operation of an apparatus that determines key touch states by calculating exponential function values. Since data for the range wherein the exponential function values reflect the greatest changes are not used, and as data for the range wherein they reflect only slight changes are used, the dynamic range for touch detection is narrowed and touch detection accuracy is degraded. Also, since the calculations performed in the predetermined period immediately following the closure of the first switch are useless, the means employed to perform the calculations, such as a microprocessor, has to carry an unnecessary load.

The above referenced Japanese Examined Publication No. Sho 58-43757 discloses that to acquire key touch characteristics that are suitable for all the keys of a keyboard the rate of change, i.e., the unit time degree of change, of touch data is adjusted in correspondence with the touch requirements of individual keys.

As key touch difference is, however, mainly derived from calculations performed during a predetermined period immediately following the closure of the first switch, it is difficult to obtain a desirable touch characteristic, for a depressed key, by controlling the rate of change of touch data.

SUMMARY OF THE INVENTION

To overcome the above shortcomings, it is an object of the present invention to provide a key touch detector, for an electronic musical instrument, that can accurately detect key touch states at a keyboard, and that can adjust key touch characteristics.

To achieve the stated object, a key touch detector, for an electronic musical instrument according to the present invention, that detects key touch states, comprises:

a first switch to be closed at a first key displacement position disposed along the line of travel of a depressed key;

a second switch to be closed at a second key displacement position disposed along the line of travel of the depressed key;

key depression detecting means for detecting a closure of the first switch and a closure of the second switch;

touch data computing means for computing touch data for the depressed key during a period that begins following the closure of the first switch and ends with the closure of the second switch; and delay means for deferring initiation of touch data computation by the touch data computing means until a predetermined time has elapsed following the closure of the first switch.

As described above, during the period between the closure of the first switch and the closure of the second switch, a key touch detector according to the present invention employs a delay means to defer the initiation of the computation of touch data, by a touch data computing means, for a predetermined time following the closure of the first switch.

DETAILED DESCRIPTION OF THE PREFERRED EMBODIMENT

The preferred embodiment of a key touch detector for an electronic musical instrument according to the present invention will now be described while referring to the accompanying drawings.

Figure 1:
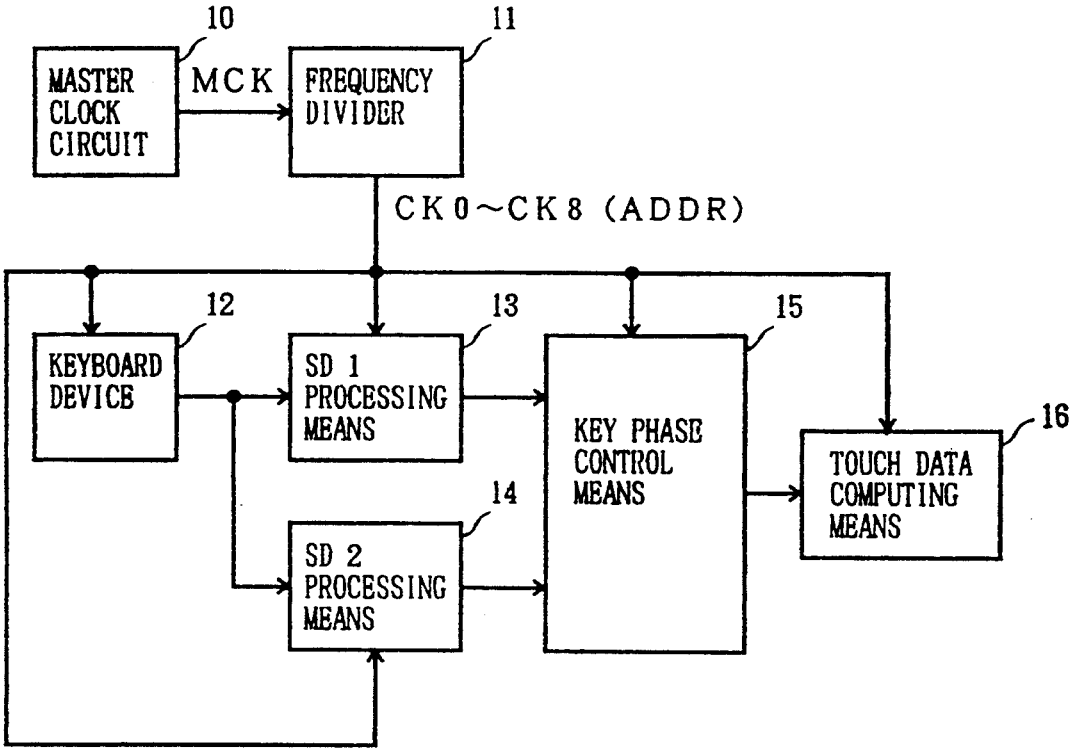
FIG. 1 is a block diagram illustrating the general arrangement of a touch detector according to one embodiment of the present invention.

FIG. 1 is a block diagram illustrating the general arrangement of a touch detector according to the embodiment of the present invention. A master clock circuit 10 outputs a master clock signal MCK. The master clock circuit 10 is connected to a frequency divider 11 that divides the frequency of the received master clock signal MCK.

A keyboard device 12, which includes the full keyboard, is connected to an SD1 processing means 13, which processes data for the first switch S1 provided for each keyboard key, and an SD2 processing means 14, which processes data for the second switch S2 provided for each keyboard key.

The SD1 processing means 13 and the SD2 processing means 14 are both connected to a key phase control means 15, which processes data for phase signals received from the respective processing means 13 and 14.

The key phase control means 15 is connected to a touch data computing means 16 that computes key touch data based on the data received from the key phase control means 15.

The keyboard device 12, the SD1 processing means 13, the SD2 processing means 14, the key phase control means 15, and the touch data computing means 16 are all connected to the frequency divider 11.

Figure 2:
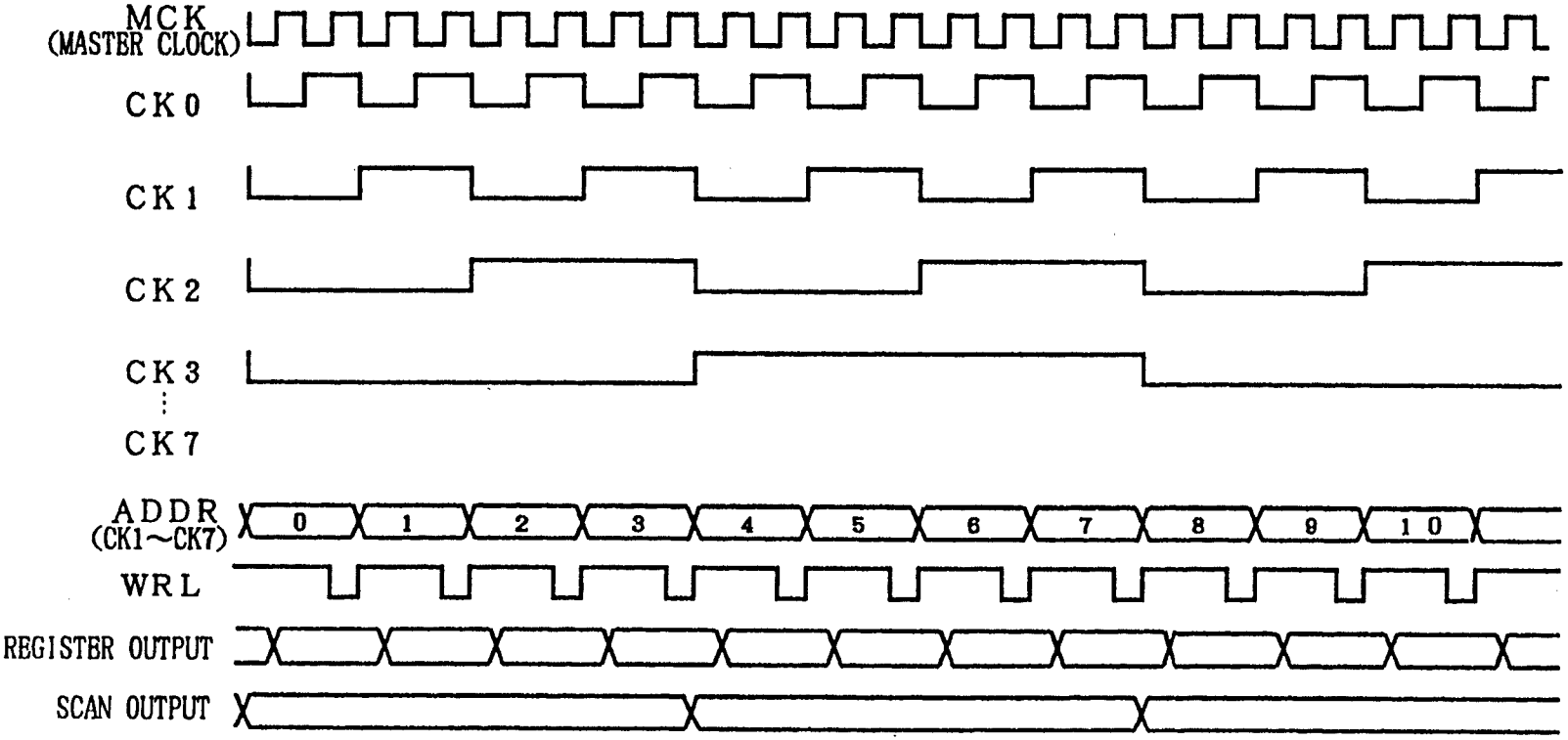
FIG. 2 is a timing chart showing operation timings of the touch detector according to the embodiment of the present invention.

The timing chart in FIG. 2 shows the operation timings for the individual means of the touch detector according to the embodiment of the present invention.

"MCK" stands for a master clock signal that is output by the master clock 10.

"CK0" to "CK7" represent respectively the clocks 0 to 7 that are produced by the frequency divider 11 when it divides the frequency of the master clock signal MCK. "CK1" to "CK7" are used as signals for designating keyboard key numbers for an electronic musical instrument that incorporates the touch detector of the present invention, and can designate key numbers for a maximum of 128 keys.

Waveforms for "CK4" to "CK7" are not included in FIG. 2.

"ADDR" represents "CK1" to "CK7" when they are regarded as address signals. With this address signal, therefore, a maximum of 128 key numbers, i.e., "0" to "127", can be designated.

"WRL" represents a write signal that is used for writing predetermined data at a position in a memory that is designated by the address signal ADDR. The write signal WRL is active low.

Register output represents the timing for temporarily storing data, which is read from a memory, in a register and outputting it therefrom.

Scan output represents the timing for switch state scanning for each key of the keyboard device 12 in consonance with CK3 to CK7.

Figure 3:
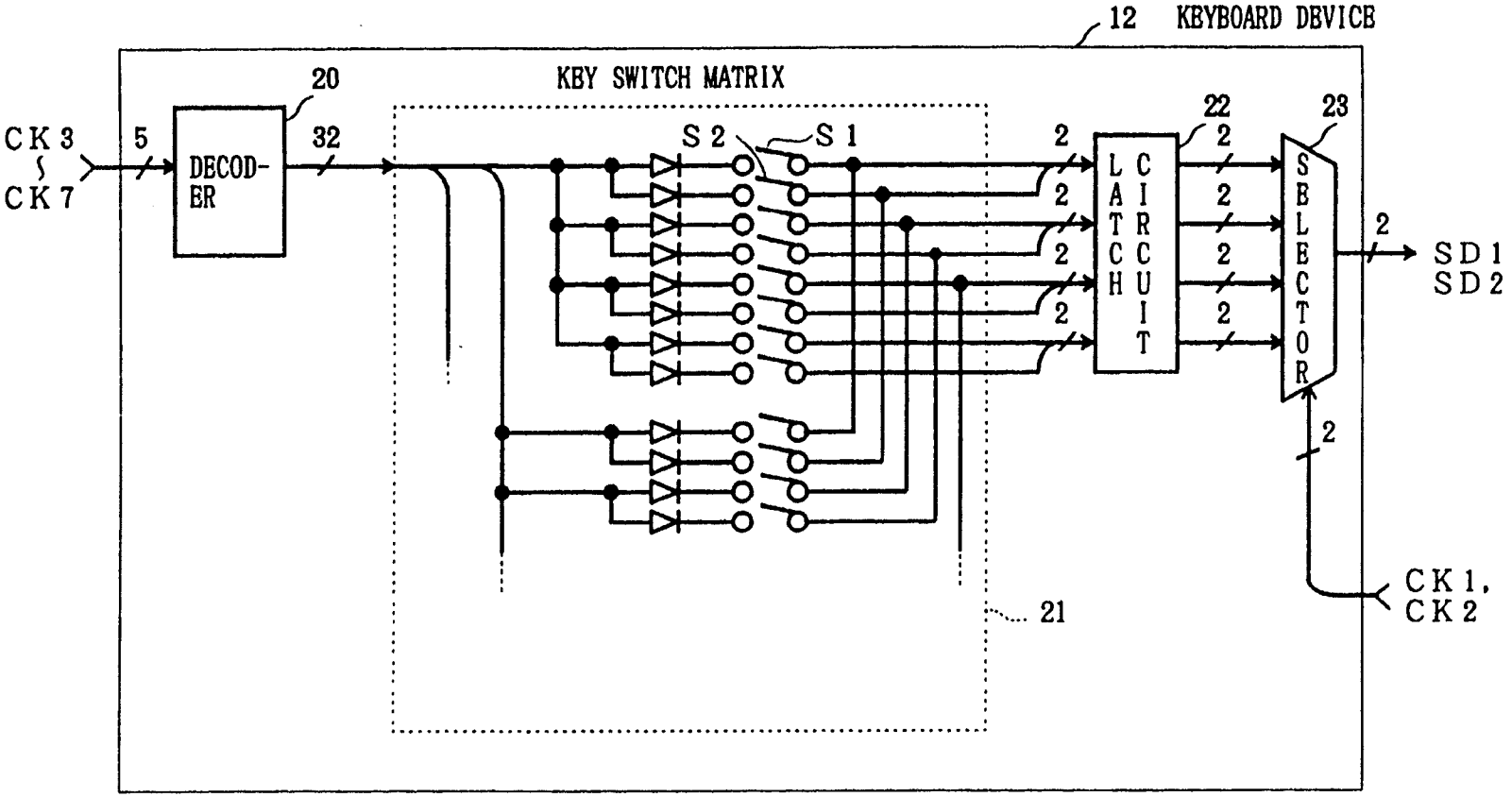
FIG. 3 is a diagram illustrating the arrangement of the keyboard device of an electronic musical instrument.

FIG. 3 is a detailed diagram of the keyboard device 12 included in FIG. 1.

The keyboard device 12 includes a decoder 20 that receives frequency divider outputs CK3 to CK7, which have been frequency-divided by the frequency divider 11, and produces scan signals for scanning the switches of the keys; a key switch matrix 21, which consists of the first switches S1 and the second switches S2 provided for the individual keys; a latch circuit 22, which latches data indicating the states of the first switch S1 and the second switch S2; and a selector 23, which receives data from the latch circuit 22 and selects data in consonance with frequency divider outputs CK1 and CK2.

Outputs CK3 to CK7, which originate at the frequency divider 11, are decoded by the decoder 20 to produce thirty-two outputs that function as scan pulse signals for scanning the first switch S1 and the second switch S2 that are associated with each key.

In this embodiment, the switches of four keys, i.e., four switch pairs (eight switches in total) are scanned at a time, and the data for the eight switch states that are obtained are latched by the latch circuit 22.

Since the latch circuit 22 detects for each key the states of its associated first switch S1 and second switch S2, the latch circuit 22 transmits four data sets, each of which sets indicates the state of a first switch S1 and its paired second switch S2. The selector 23 selects one data set in accordance with the signals CK1 and CK2.

The selector 23 then outputs signals SD1 and SD2, which indicate the states of the first switch S1 and the second switch S2 of the selected data set.

Figure 4:
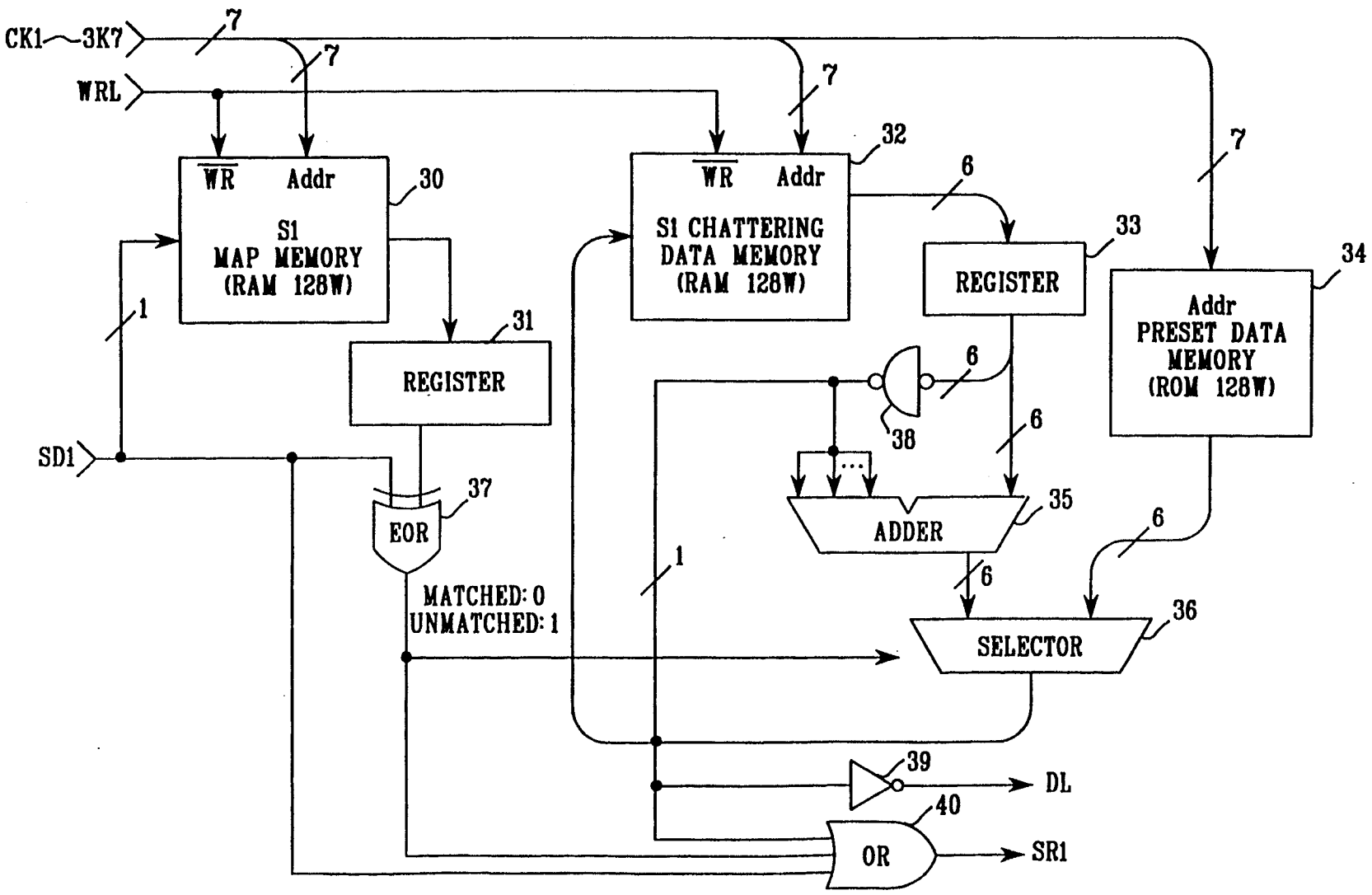
FIG. 4 is a diagram illustrating the arrangement of a first switch data processing means.

FIG. 4 illustrates in detail the SD1 processing means 13 shown in FIG. 1.

As illustrated, the SD1 processing means 13 includes an S1 map memory 30, a register 31, an S1 chattering data memory 32, a register 33, a preset data memory 34, an adder 35, a selector 36, and other gates 37 to 40.

During the rapid closing and opening of the contacts of the first key switches S1, i.e., during the occurrence of chattering, the SD1 processing means 13 detects the key depression states and inhibits touch data computation by the touch data computing means 16. When the chattering ceases, and after a predetermined time has elapsed, the SD1 processing means 13 generates a signal DL, which enables initiation of touch data computation by the touch data computing means 16.

In the S1 map memory 30 are stored data SD1 that indicate the state of the first switch S1. A RAM (Random Access Memory) with a memory capacity of 128 words is used as the S1 map memory 30. Upon receipt of frequency divider outputs CK1 to CK7, which designate addresses, and a write signal WRL, data is written to the S1 map memory 30.

The data SD1 in the S1 map memory 30 are read out and held in the register 31. An exclusive-OR gate (hereafter referred to as an "EOR gate") 37 compares this data SD1 with newly received data SD1 that indicate the current state of the first switch S1.

When the value of the data SD1 that has been held in the register 31 matches the value of the new data SD1, the EOR gate 37 outputs a value of "0". When the value of the previously held data SD1 does not match the new data SD1, the EOR gate 37 outputs a value of "1".

During the data comparison by the EOR gate 37, the new data SD1 are written to the S1 map memory 30.

A ROM (Read Only Memory) with a 128 word capacity is used as a preset data memory 34. Addresses for data reading are designated upon receipt of frequency divider outputs CK1 to CK7 in the same manner as for the S1 map memory 30.

In the preset data memory 34 are stored, for each key, initial instruction data values, i.e., initial chattering data values, that inhibit the processing of signals that are produced, by the rapid closing and opening of switches, during a period immediately following the initiation of chattering.

In the S1 chattering data memory 32 are stored chattering data relating to data SD1, which indicate the state of the first switch S1.

Like the S1 map memory 30, the S1 chattering data memory 32 is a RAM that has a 128 word memory capacity. Upon receipt of frequency divider outputs CK1 to CK7, which designate addresses, and a write signal WRL, data is written in the S1 chattering data memory 32.

The data contents of the S1 chattering data memory 32 are read out and held temporarily by the register 33, and are then transmitted to the adder 35.

When a value for the chattering data held in the register 33 is not "0", that value is decremented by one by the adder 35.

At this time, when the contents of the data SD1 match the contents of the map memory 30, the selector 36 selects the output of the adder 35 and returns that data to the S1 chattering data memory 32, and that data is written therein.

When the data SD1 do not match the contents of the S1 map memory 30, the selector 36 selects the output of the preset data memory 34 and transmits that data to the S1 chattering data memory 32, and that data is written therein to initialize the chattering data.

When the value of the chattering data is "0", a value "0" is output by the adder 35 and a computation enabling signal DL, which is output by an inverter 39, becomes active high.

When the value of the chattering data is other than "0", a value of the data SD1 that indicates the state of the first switch S1 is masked to obtain a value of "1" and is output as a data signal SR1 from which chattering has been eliminated.

Figure 5:
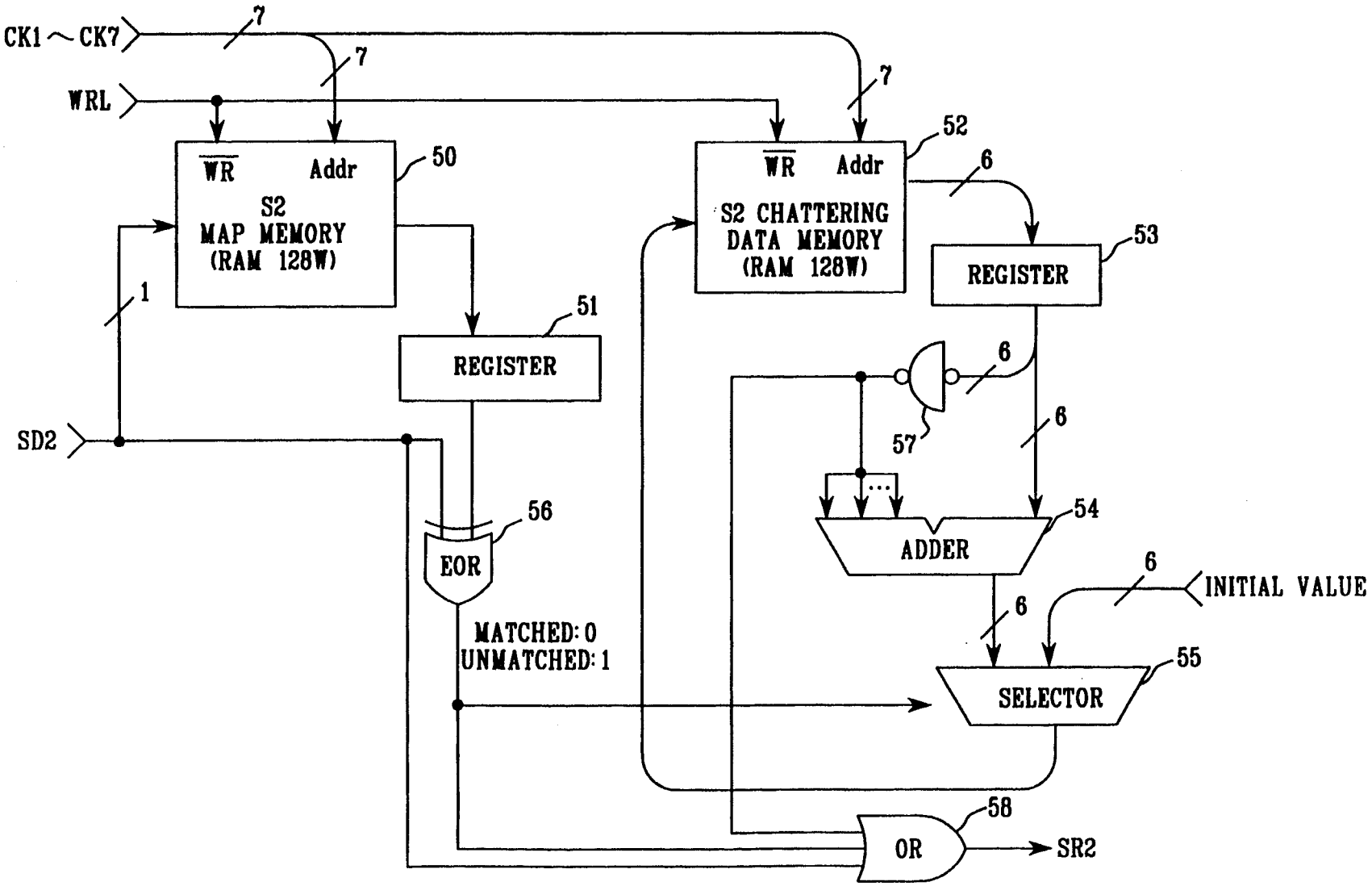
FIG. 5 is a diagram illustrating the arrangement of a second switch data processing means.

FIG. 5 illustrates in detail the SD2 processing means 14 that is shown in FIG. 1.

As illustrated, except for the preset data memory 34 (see FIG. 4), the SD2 processing means 14 has the same components as those possessed by the SD1 processing means 13. In other words, the SD2 processing means 14 includes an S2 map memory 50, a register 51, an 52 chattering data memory 52, a register 53, an adder 54, a selector 55, and other gates 56 to 58.

In the place of the preset data memory 34, which is used to store the initial values of the chattering data for all the keyboard keys, to initialize chattering data the SD2 processing means 14 selects and stores, as a given value, a common fixed initial value for all the keys.

As the SD2 processing means 14 performs the same processing for the second switch S2 as the SD1 processing means 13 performs for the first switch S1, a detailed explanation of the procedures performed by the SD2 processing means 14 will not be given.

Figure 6:
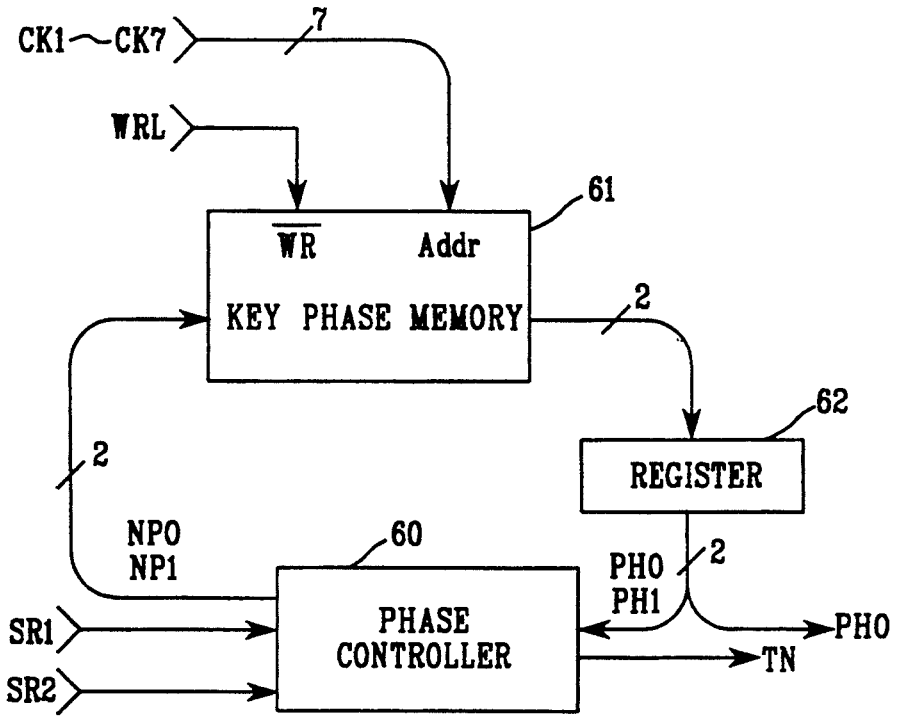
FIG. 6 is a diagram showing the arrangement of a key phase control means.

FIG. 6 illustrates the detailed arrangement of the key phase control means 15 that is shown in FIG. 1.

As illustrated, the key phase control means 15, which controls the phases of the keyboard keys, includes a phase controller 60, a key phase memory 61 and a register 62.

Figure 7:
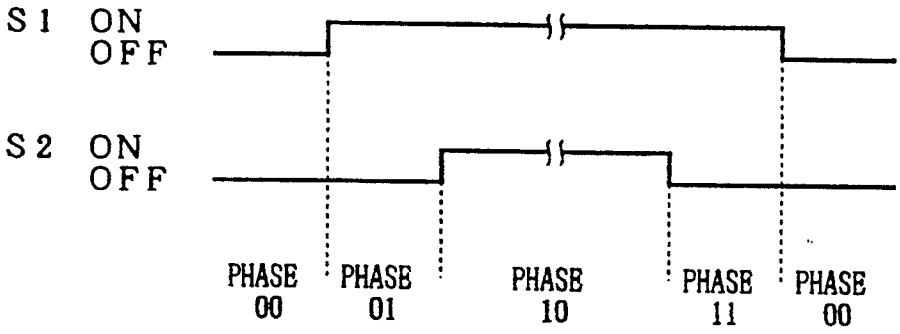
FIG. 7 is a diagram for explaining key phases.

The key phases are defined based on the states of the first switch S1 and the second switch S2 (see FIG. 7). Their definitions are as follows:

Phase [00]: when a key has been released
Phase [01]: when a key is being depressed
Phase [10]: when a key is depressed
Phase [11]: when a key is being released Key phase data that indicate key phase states are stored in the key phase memory 61. A RAM that has a 128 word capacity is used for the key phase memory 61. Upon receipt of frequency divider outputs CK1 to CK7, which designate addresses, and a write signal WRL, data is written to the key phase memory 61.

The contents of the key phase memory 61 are read out and held by the register 62. The outputs PH0 and PH1 of the register 62, and the signals SR1 and SR2, which carry respectively the states of the first and second switches S1 and S2 and from which cattering has been eliminated, are transmitted to the phase controller 60.

Upon receipt of the signals SR1 and SR2, the phase controller 60 outputs new phase data NP0 and NP1 and a touch data initialization signal TN.

Figure 8:
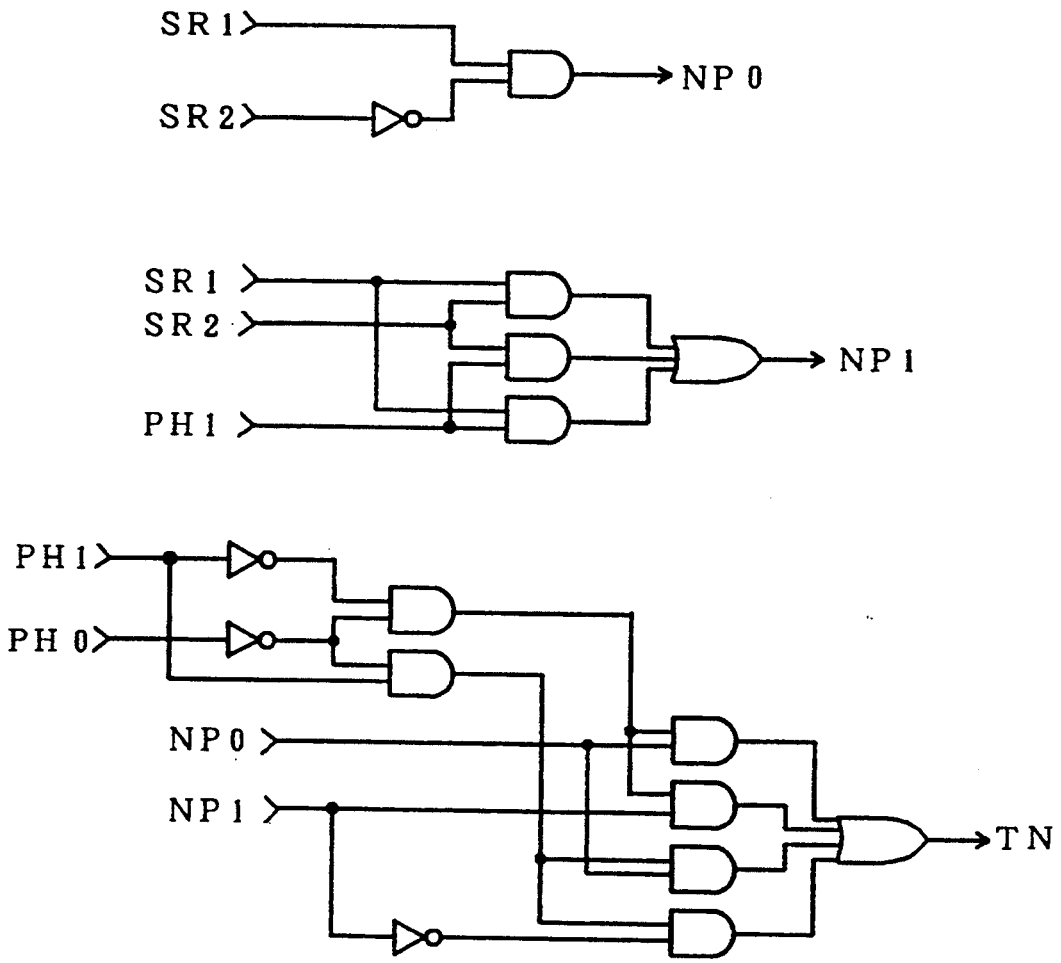
FIG. 8 is a detailed diagram illustrating an example of a phase controller.

FIG. 8 is a detailed diagram of an example of the phase controller 60. The correlations between the inputs (PH1 to PH0, SR1, and SR2) of the phase controller 60 and its outputs (NP1 to NP0) are shown in Table 1 below.

TABLE 1

| Previous Key Phase | Switch State | | New Key Phase |
|---|---|---|---|
| PH1 to PH0 | SR1 | SR2 | NP1 to NP0 |
| 00 | 0 | 0 | 00 |
| 00 | 0 | 1 | 00 |
| 00 | 1 | 0 | 01 |
| 00 | 1 | 1 | 10 |
| 01 | 0 | 0 | 00 |
| 01 | 0 | 1 | 00 |
| 01 | 1 | 0 | 01 |
| 01 | 1 | 1 | 10 |
| 10 | 0 | 0 | 00 |
| 10 | 0 | 1 | 10 |
| 10 | 1 | 0 | 11 |
| 10 | 1 | 1 | 10 |
| 11 | 0 | 0 | 00 |
| 11 | 0 | 1 | 10 |
| 11 | 1 | 0 | 11 |
| 11 | 1 | 1 | 10 |

Although the switch states SR1="0" and SR2="1" are not probable as long as keys are normally operated, new outputs NP1 to NP0 are defined for these states.

The touch data initialization signal TN becomes active, or "1", when the key phase is changed as follows:

00→01 . . . initialize touch data upon key depression
00→10 . . . initialize touch data upon key depression
10→11 . . . initialize touch data upon key release
10→00 . . . initialize touch data upon key release Table 2 shows the changes of key phases in this example, i.e., correlations with previous key phases (PH1 to PH0), new key phases (NP1 to NP0), and touch data initialization signals.

TABLE 2

| Previous Key Phase (PH1 to PH0) | New Key Phase (NP1 to NP0) | Touch Data Initialization Signal (TN) |
|---|---|---|
| 00 | 00 | 0 |
| 00 | 01 | 1 |
| 00 | 10 | 1 |
| 00 | 11 | * |
| 01 | ** | 0 |
| 10 | 00 | 1 |
| 10 | 01 | * |
| 10 | 10 | 0 |
| 10 | 11 | 1 |
| 11 | ** | 0 |

In Table 2, "*" indicates that no output can be defined because a key phase change can not be performed, and "**" indicates that a new key phase value may be arbitrarily selected.

Figure 9:
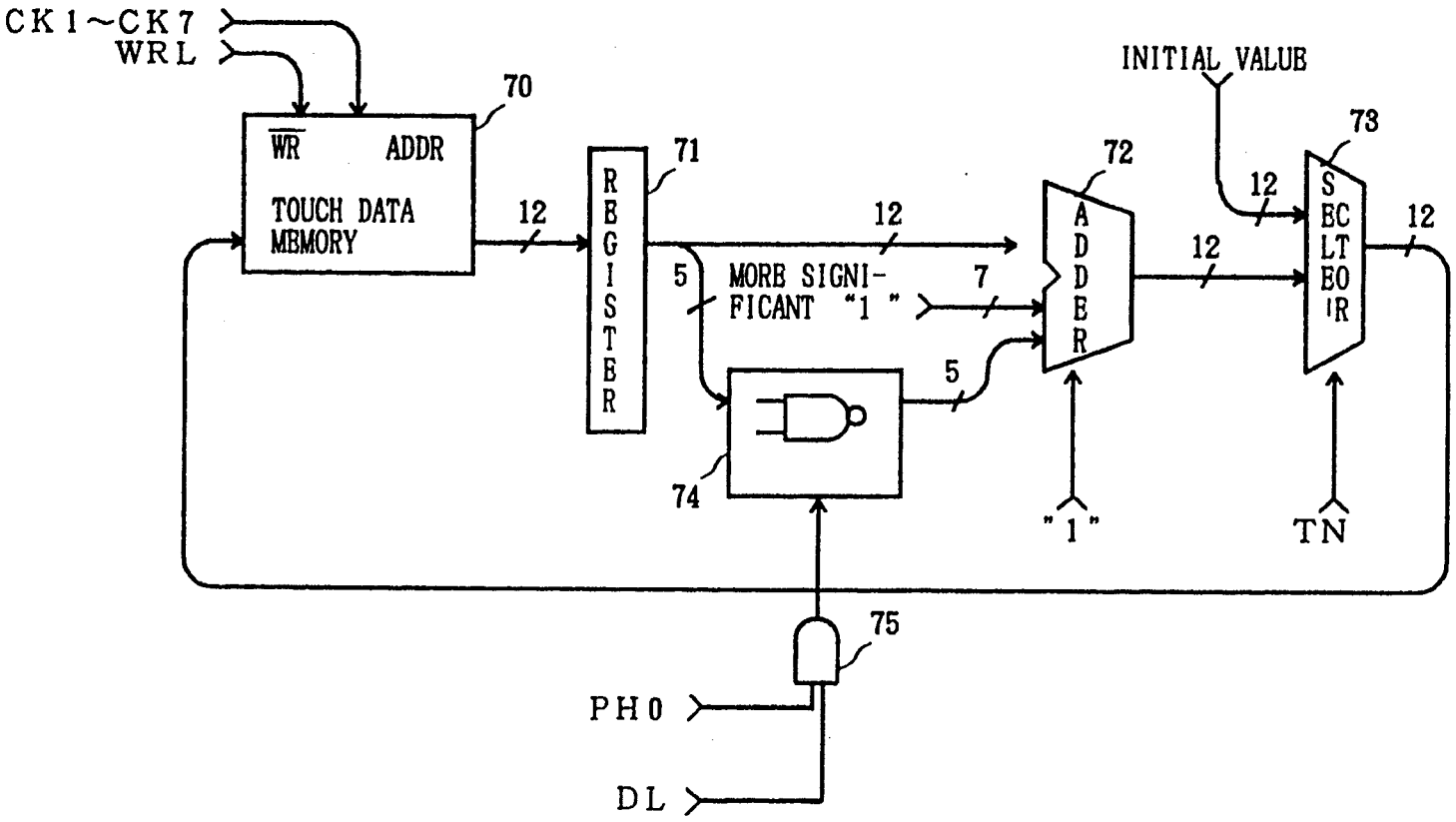
FIG. 9 is a diagram showing the arrangement of a touch data computing means.

FIG. 9 illustrates the detailed arrangement of the touch data computing means 16 that is shown in FIG. 1.

The touch data computing means 16 includes a touch data memory 70, wherein data is written when an address is designated by frequency divider outputs CK1 to CK7 and a write signal WRL is input; a register 71, which is connected to the touch data memory 70 to temporarily hold touch data that is read from the memory 70; an adder 72, which is connected to the register 71; a selector 73, which is connected to the touch data memory 70 and is also connected to the adder 72 to select the output by the adder 72 in accordance with a predetermined value; NAND gates 74, which are connected to both the register 71 and the adder 72; and an AND gate 75.

Touch data corresponding to 128 keys are written in the touch data memory 70. Upon receipt of frequency divider outputs CK1 to CK7, which designate addresses, and a write signal WRL, the data are written to the touch data memory 70. Like the previously described storage means, a RAM with a 128 word capacity is used for the touch data memory 70.

The touch data that is read from the touch data memory 70 is temporarily held by the register 71, and is then transmitted to one of the input terminals of the adder 72.

The data held by the register 71 are shifted seven bits and the resultant five more significant data bits are transmitted through the NAND gates 74 to the other input terminal of the adder 72.

When the key phase is either [01] or [11] and the computation enabling signal DL is active H, the adder 72 calculates and outputs an exponential function value. In other cases, the adder 72 outputs the data received from the register 71 unchanged.

The selector 73 selects the output by the adder 72 when the touch data initialization signal TN is not active. The selected data are then written to the touch data memory 70 to update its contents.

When the touch data initialization signal TN is active, the selector 73 selects an initial value, i.e., a predetermined fixed value, that is stored in a predetermined storage means (not shown). The selected initial value is then written to the touch data memory 70 to update its contents.

Figure 10:
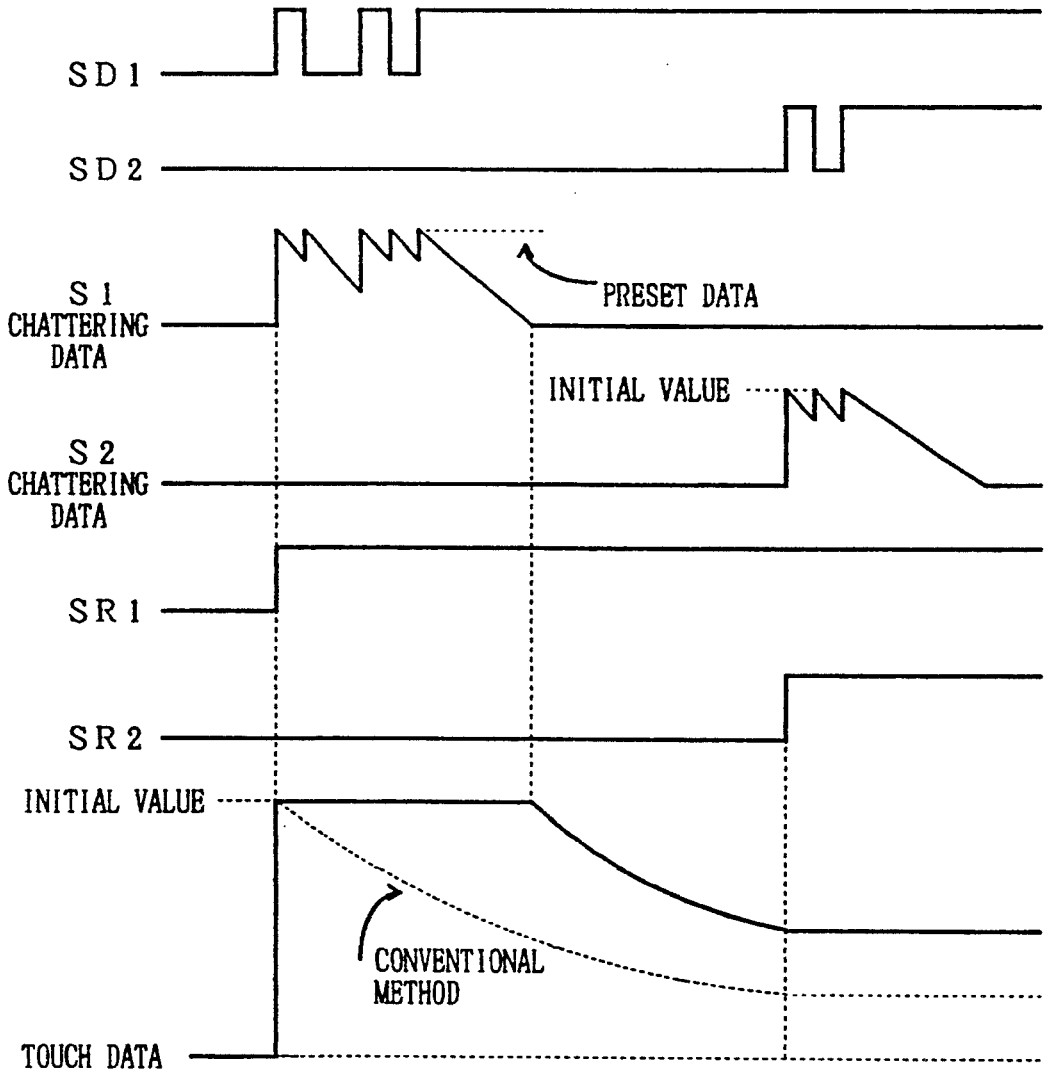
FIG. 10 is a diagram for explaining the correlations of the data that are processed by the several means of the touch detector according to the present invention.

The correlations of the data processed by the several processing means of the key touch detector of the above described embodiment are as shown in FIG. 10.

In this embodiment, chattering data for the first switch S1 are used to determine the length of time to defer the initiation of touch data computation by the touch data computing means 16. An independent means for computing and storing such data could be provided.

Also, a chattering data memory and a touch data memory could be arranged at separate addresses in a single RAM, and chattering data and touch data could be separately computed by the time-shared employment of a single adder.

In this embodiment a preset data memory is provided to select "delay data" for each key. To simplify delay data acquisition, several initial values could be stored in the preset data memory and selectively read out for depressed keys. For example, two initial values, one for white keys and the other for black keys, could be stored in the preset data memory. Then, when a key was depressed, the delay data for the key group to which the key belonged would be read out. Also, "delay data" could be selected for multiple desired tone ranges, or "delay data" could be selected for multiple desired timbre selecting means for data control switching.

What is claimed is:

1. A key touch detector, for an electronic musical instrument having a plurality of keys, said detector detecting the key touch states of said keys and providing an output indicative of the force with which the keys are depressed, said key touch detector comprising:

a first switch to be closed at a first key displacement position disposed along a line of travel of a depressed key;

a second switch to be closed at a second key displacement position disposed along the line of travel of said depressed key;

key depression detecting means coupled to said switches for detecting a closure of said first switch and a closure of said second switch;

touch data computing means for computing touch data for said depressed key during a period that begins following said closure of said first switch and ends with said closure of said second switch, said touch data comprising said output indicative of the force with which said key is depressed; and delay means coupled to said key depression detecting means and said touch data computing means for deferring initiation of touch data computation by said touch data computing means until after a predetermined time has elapsed following said closure of said first switch.

2. A key touch detector according to claim 1, wherein said touch data computing means employs an exponential function to compute touch data.

3. A key touch detector according to claim 1, wherein said delay means establishes a delay time for deferring initiation of touch data computation in consonance with the particular key that is depressed.

4. A key touch detector according to claim 1, wherein said delay means also comprises chattering removal means for eliminating chattering for said first switch.

5. A key touch detector according to claim 2, wherein said delay means also comprises chattering removal means for eliminating chattering for said first switch.

6. A key touch detector according to claim 3, wherein said delay means also comprises chattering removal means for eliminating chattering for said first switch.

7. A key touch detector according to claim 1 wherein said delay means establishes a delay time for deferring initiation of touch data computation for each group of a plurality of groups of keys formed of said plurality of keys.

8. A key touch detector according to claim 1 wherein said delay means establishes a delay time for deferring initiation of touch data computation for each group of a plurality of groups of keys formed of said plurality of keys, each of said groups of keys representing desired tone ranges in said plurality of keys.

9. A key touch detector according to claim 1 wherein said delay means establishes a delay time for deferring initiation of touch data computation in accordance with a timbre property attributable to one or more of said keys.

* * * * *